United States Patent [19]

Seeley

[11] Patent Number: 4,602,487

[45] Date of Patent: Jul. 29, 1986

[54] WATER DISTRIBUTION MEANS FOR AIR COOLER

[75] Inventor: Frederic F. Seeley, St. Marys, Australia

[73] Assignee: Coolair Corporation, Singapore

[21] Appl. No.: 611,683

[22] Filed: May 18, 1984

[30] Foreign Application Priority Data

May 18, 1983 [AU] Australia ..... PF9415

[51] Int. Cl.[4] ..... F28D 5/00

[52] U.S. Cl. ..... 62/304; 261/106; 261/DIG. 41

[58] Field of Search ..... 62/304, 309, 311; 261/106, 107, DIG. 3, 94, 95, 100, DIG. 41

[56] References Cited

U.S. PATENT DOCUMENTS

| | | | |
|---|---|---|---|
| 2,535,386 | 12/1950 | Brookins | 261/106 |
| 3,284,068 | 11/1966 | Goettl | 261/106 |
| 3,716,043 | 2/1973 | Chilcoat | 261/106 |
| 4,338,264 | 7/1982 | Seeley | 261/106 X |
| 4,460,520 | 7/1984 | Wrightson | 261/DIG. 3 X |

*Primary Examiner*—Henry Bennett

*Attorney, Agent, or Firm*—Henry Sternberg; Bert J. Lewen

[57] ABSTRACT

A plate-like water distributor having a plurality of upstanding ribs which deflect a flow of water into a plurality of streams which discharge over a downturned peripheral edge, the underside of the distributor near that edge having a plurality of retaining means thereon which engage and retain the upper end of an absorptive pad.

6 Claims, 6 Drawing Figures

WATER DISTRIBUTION MEANS FOR AIR COOLER

This invention relates to improvements to water distribution means for an evaporative type air cooler, and to a cooler which embodies those improvements. The invention relates to further improvements to the cooler described in our Australian Patent specification No. 56612/80 (PD 8219), on which is based our U.S. Continuation-in-Part Application No. 497,699 dated May 24, 1983, which contains descriptions of relevant components.

BACKGROUND OF THE INVENTION

Woodwool is normally used to provide a large surface area for the evaporation of water in an evaporative type cooler, and the most successful woodwool pad arrangement used at the present time has fibres of woodwool retained together by a wire cage. Other absorptive materials may be used in lieu of woodwool. This functions very satisfactorily, but one of the problems is that the woodwool gradually sags, or reduces its height, and with previously proposed water distribution means, a gap sometimes develops between the distributor and the upper edge of the woodwool pad, and this functions as a "short circuit" allowing water droplets to be picked up by the stream of air which would otherwise pass entirely through the pad.

BRIEF SUMMARY OF THE INVENTION

One object of this invention therefore is to provide improvements wherein the likelihood of development of such a gap is substantially reduced, and in one embodiment of this invention the improvements comprise a plate-like water distributor having a plurality of upstanding ribs which deflect a flow of water into a plurality of streams which discharge over a downturned peripheral edge, the underside of the distributor near that edge having a plurality of retaining means thereon which engage and retain the upper end of an absorptive pad. With this arrangement, the woodwool (or other absorptive) pad is so joined to the distributor that a sub-assembly is formed, and as sagging occurs, the distributor itself lowers in height, without there being development of any substantial gap between the two.

More specifically, the invention consists of a plate-like water distributor having a water receiving area on its upper surface, the remaining area of the upper surface being a sloping area which slopes downwardly from the water receiving area to a peripheral edge, and a plurality of ribs upstanding from the sloping area and extending from the water receiving area to the peripheral edge to divide water, when discharged onto said water receiving area, into a plurality of streams which discharge over the peripheral edge of the plate-like distributor, a plurality of retaining means on the underside of the plate-like distributor near said peripheral edge, and an absorptive pad engaged by said retaining means and depending from said plate-like member near said peripheral edge.

One of the tasks which confronts a user of an evaporative cooler is that of cleaning the cooler, and in an embodiment of this invention, the lower end of the woodwool pad is located but not retained within an evaporative type cooler so that when the distributor is lifted, the woodwool pad comes out with it, and can be removed for easy cleaning.

BRIEF DESCRIPTION OF THE DRAWINGS

An embodiment of the invention is described hereunder in some detail with reference to, and is illustrated in, the accompanying drawings, in which.

Figure 1:
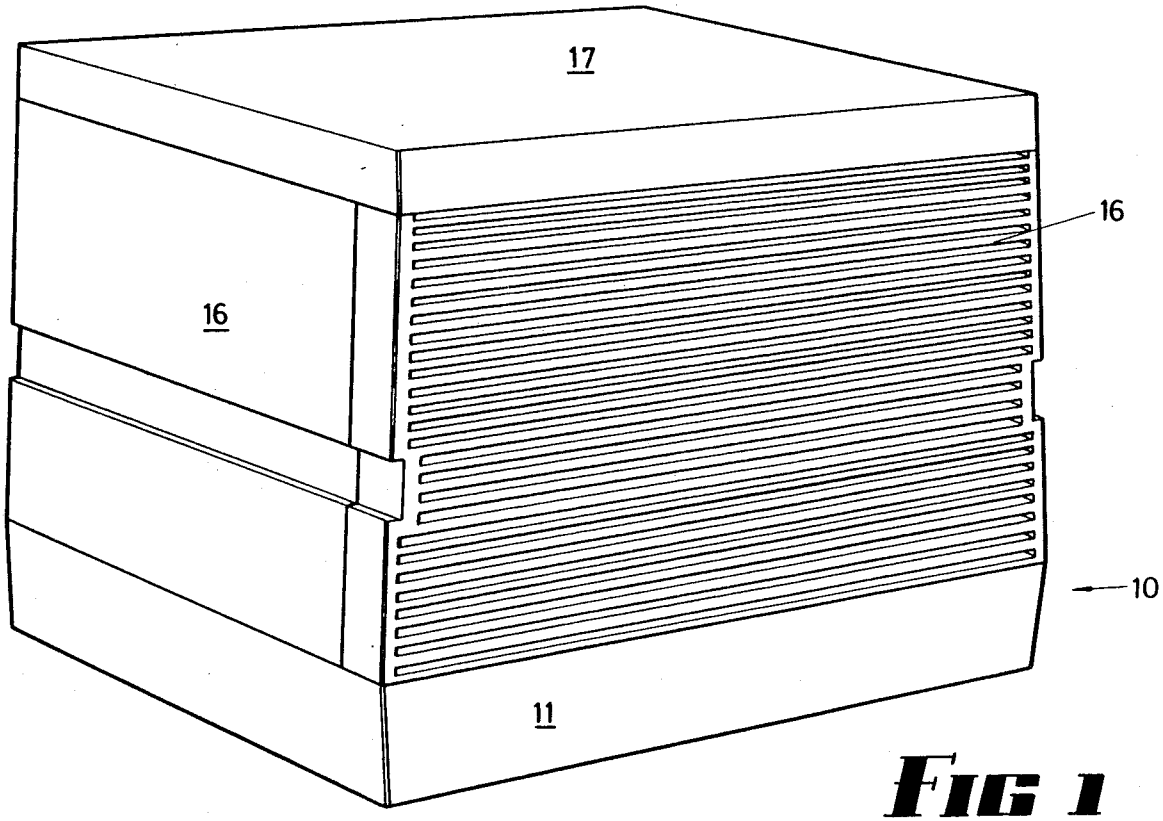
FIG. 1 is a perspective view of a cooler which embodies the invention.
Figure 2:
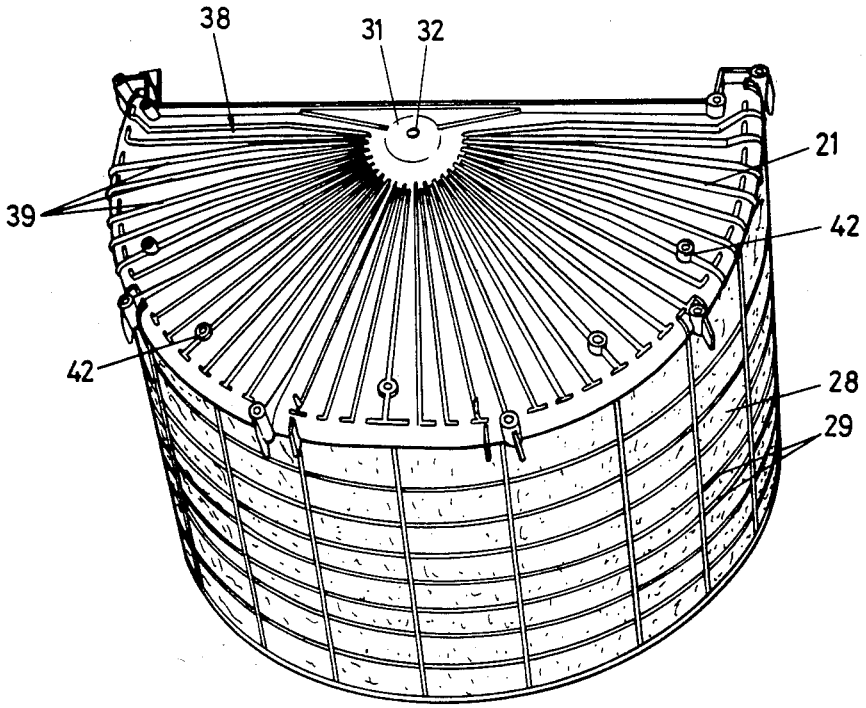
FIG. 2 is a fragmentary perspective showing a subassembly of a water distributor and woodwool pad.
Figure 3:
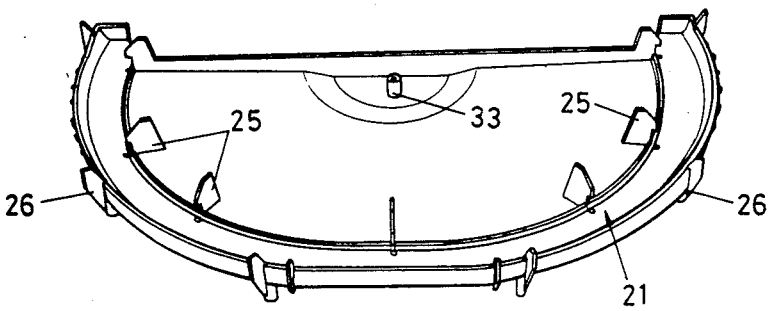
FIG. 3 is an underside perspective of the water distributor.
Figure 4:
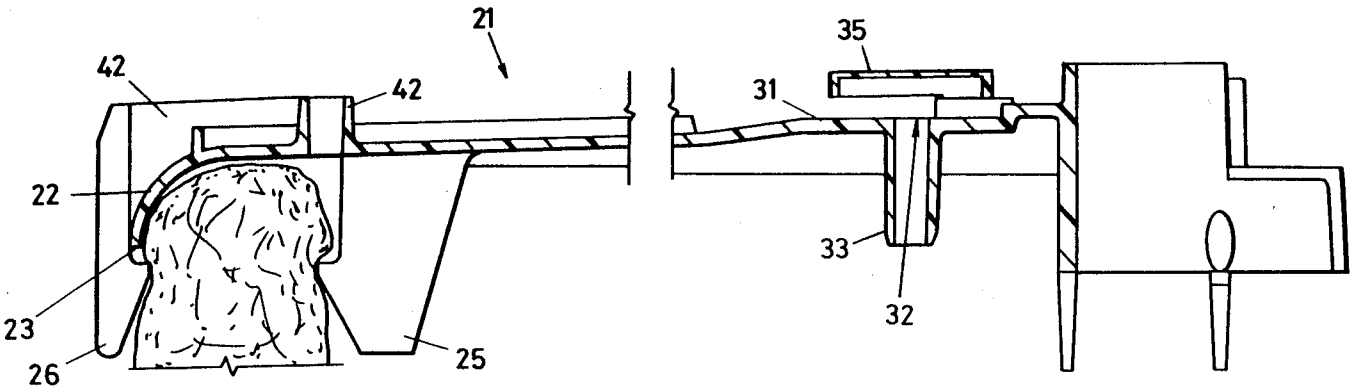
FIG. 4 is a central section through the water distributor.

In this embodiment an air cooler 10 of the evaporative type is provided with a rectangular base tank 11, a pad support platform 12 within the base tank 11, a radially inner group of lower lugs 13 which are upstanding from the pad support platform 12 and a radially outer group of lower lugs 14, also upstanding from the platform 12. A cabinet is provided with side walls 16, the front and rear side walls being perforate by means of louvres, these side walls 16 are upstanding from respective sides of the base tank 11, and they are surmounted by a removable lid 17.

Within the cabinet there is provided a blower type fan within a volute 20, a plate type water distributor 21 located above the volute 20, the water distributor 21 being of generally semi-circular shape in plan and having a downturned flange 22 around its curved edge, the peripheral edge over which water flows being the lower edge 23 of the flange 22.

Figure 6:
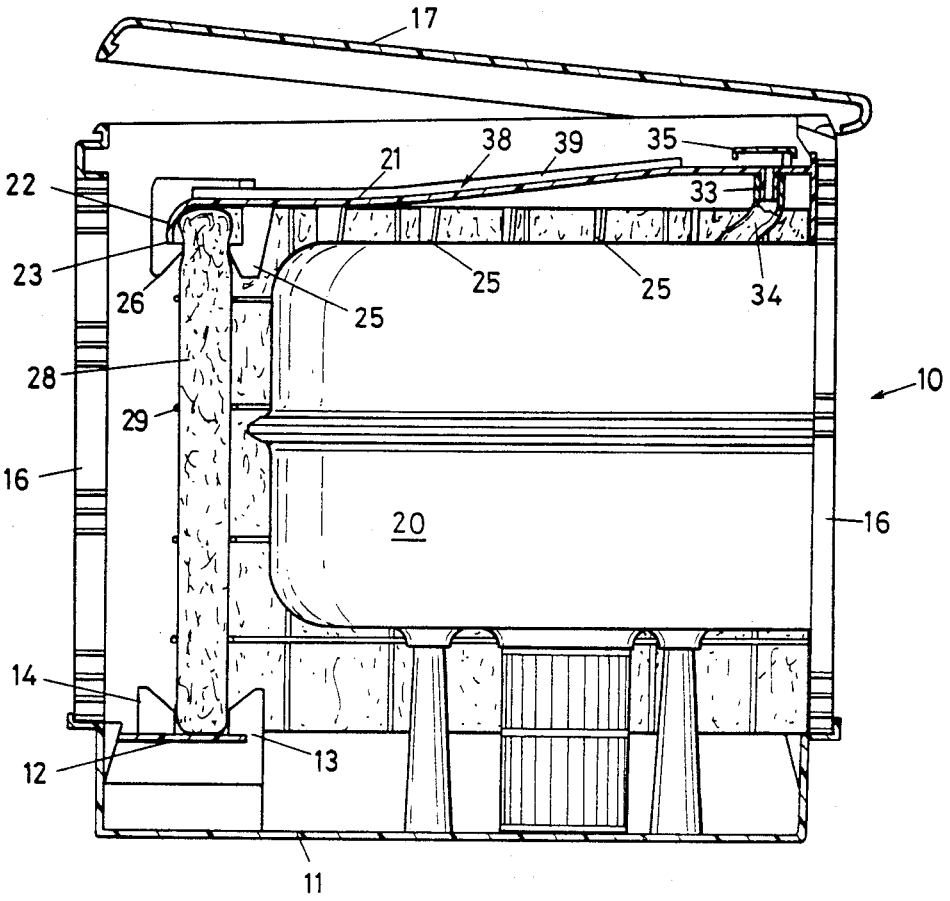
FIG. 6 is a central section showing said subassembly within an evaporative cooler.

The underside of a water distributor 21 is provided with a radially inner group of upper lugs 25 and a radially outer group of upper lugs 26 spaced therefrom and as seen best in FIG. 6, each upper lug is of hook-like configuration, the hook portions of said lugs in said groups being directed towards inner and outer faces respectively of the woodwool pad 28 and releasably engaging those faces at the upper end of the curved woodwool pad 28 which is contained in a wire cage 29, in such a way that the water distributor 21 and woodwool pad 28 form a sub-assembly which can be lifted away from the supporting platform 12 but when lowered into the cabinet the lower edge of the pad 28 is supported by platform 12 and located by the lower lugs 13 and 14. Since the lid 17 is readily removable, removal of the sub-assembly 21/28 is exceedingly simple, and since the water distributor 21 is wholly supported by the woodwool pad 28 and its cage 29, any sagging which occurs will merely result in lowering of the water distributor 21 without development of a gap which occurs in some prior art coolers, and which permits droplets of water to be entrained in the airstream created by the blower type fan in volute 20.

Reference is now made to FIGS. 2, 3, 4 and 5 which show the improved water distributor 21 in greater detail. The distributor 21 is provided with a generally planar water receiving area 31 surrounding a water inlet orifice 32 at the upper end of a tail 33 which receives water from a pump (not shown) via a flexible hose 34 (FIG. 6), the water discharging through the orifice 32 against an inverted dish-like deflector 35 which deflects the stream of water back onto the water receiving area 31.

The remaining area of the upper surfaces is designated 38 which slopes and this is subdivided by a plurality of ribs 29 which are upstanding from the area 38 and extending from the water receiving area 31 to the downturned flange 22 and its peripheral edge 23 around the curved portion of the periphery of the distributor 21.

Figure 5:
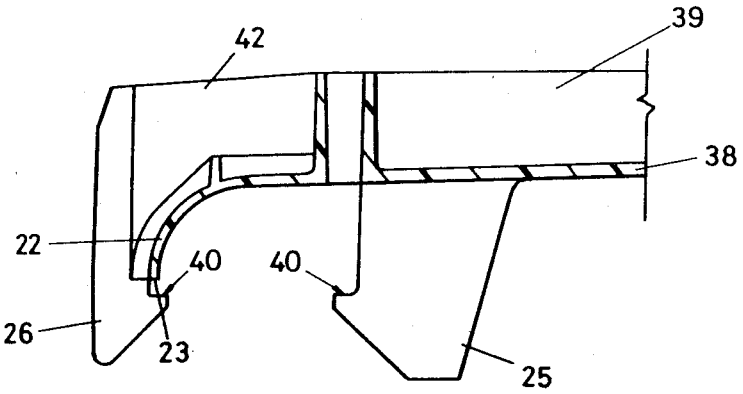
FIG. 5 is a fragmentary section, drawn to an enlarged scale, showing the retaining means for the woodwool pad.

As seen best in FIG. 5, the lugs 25 and 26 extend downwardly, each having a respective support surface 40, the lugs thereby being of general hook-like configuration and the inner and outer upper lugs are arranged near the flange 22 on pitch lines which are spaced appropriately for the lugs to retain the upper end of woodwool pad 28. The sole function of the upstanding hollow bushes 42 is to enable simplification of the moulding of the lugs 25 and 26 and these perform no part in the function of the cooler.

I claim:

1. Improvements in water distribution means for an evaporative type air cooler, comprising a plate-like water distributor having a water receiving area on its upper surface, the remaining area of the upper surface being a sloping area which slopes downwardly from the water receiving area to a peripheral edge, and a plurality of ribs upstanding from the sloping area and extending from the water receiving area to the peripheral edge to divide water, when discharged onto said water receiving area, into a plurality of streams which discharge over the peripheral edge of the plate-like distributor, a plurality of hook-shaped retaining lugs on the underside of the plate-like distributor near said peripheral edge, and an absorptive pad, said hookshaped retaining lugs comprising an inner group of lugs and an outer group of lugs, the hook portions of said lugs in said groups being directed towards inner and outer faces respectively of the absorptive pad and releasably engaging those faces at the upper end of the pad such that said pad is carried by, and depends from, said plate-like distributor near said peripheral edge.

2. Improvements according to claim 1 wherein the plan shape of said peripheral edge is generally semicircular, and said edge is comprised in a downturned flange of the distributor.

3. Improvements according to claim 1 wherein said peripheral edge of the water distributor is of generally semi-circular shape in plan, the water distributor having a downwardly curved flange which terminates in said peripheral edge, said groups of lugs comprising a radially inner group of lugs and a radially outer group of lugs near the flange.

4. Improvements according to claim 3, wherein said absorptive pad comprises a curved woodwool pad contained in a wire frame, the pad being supported at its lower end by support surfaces on the base tank, and the upper end of the pad being between the groups of lugs and releasably retained to the water distributor thereby.

5. An evaporative type air cooler having a rectangular base tank, a pad support platform in the base tank, a radially inner group of lower lugs and a radially outer group of lower lugs upstanding from the pad support platform, a cabinet having side walls upstanding from respective sides of the base tank, a removable lid carried by the side walls, a blower type fan in a volute within the cabinet, a plate-like water distributor within the cabinet, said water distributor having a downwardly curved flange which terminates in a peripheral edge, said peripheral edge being of curved shape in plan, said plate-like water distributor comprising a radially inner group of upper lugs and a radially outer group of upper lugs near said peripheral edge thereof, each upper lug being of hook-like configuration, and a curved woodwool pad contained in a wire frame, the pad partly surrounding the fan volute, the lower end of the pad being supported by said platform and located by said lower lugs, the upper end of the pad supporting said plate-like water distributor, and being joined thereto as a subassembly by operative engagement with said upper lugs.

6. Improvements according to claim 1 wherein said lugs in said inner group of lugs are spatially staggered with respect to said lugs in said outer group of lugs, so that said lugs of said inner group are not positioned in direct opposition to said lugs of said outer group, whereby said pad is not substantially compressed in response to being retained by said lugs.

* * * * *